US005881814A

United States Patent [19]

Mills

[11] Patent Number: 5,881,814

[45] Date of Patent: Mar. 16, 1999

[54] APPARATUS AND METHOD FOR DUAL-ZONE WELL PRODUCTION

[75] Inventor: Robert A. R. Mills, Bragg Creek, Canada

[73] Assignee: Kudu Industries, Inc., Canada

[21] Appl. No.: 889,309

[22] Filed: Jul. 8, 1997

[51] Int. Cl.[6] ..... E21B 43/14

[52] U.S. Cl. ..... 166/313; 166/106

[58] Field of Search ..... 166/313, 105, 166/106, 369, 186

[56] References Cited

U.S. PATENT DOCUMENTS

| | | | |
|---|---|---|---|
| 3,460,626 | 8/1969 | Ehrlich | 166/313 |
| 3,746,089 | 7/1973 | Vencil | 166/106 |
| 4,432,416 | 2/1984 | Welch et al. | 166/117.5 |
| 4,637,468 | 1/1987 | Derrick | 166/313 X |
| 4,726,422 | 2/1988 | Helderle et al. | 166/133 |
| 5,184,677 | 2/1993 | Dobscha et al. | 166/187 |
| 5,226,485 | 7/1993 | Dobscha et al. | 166/387 |
| 5,337,808 | 8/1994 | Graham | 166/191 |
| 5,447,416 | 9/1995 | Wittrisch | 166/313 X |
| 5,501,277 | 3/1996 | Onan t al. | 166/293 |
| 5,579,838 | 12/1996 | Michael | 166/106 |
| 5,707,221 | 1/1998 | Wittrisch | 166/313 X |

*Primary Examiner*—Frank S. Tsay
*Attorney, Agent, or Firm*—Pendorf & Cutliff

[57] ABSTRACT

A method and an apparatus for producing fluid hydrocarbons through a single production tubing string from first and second zones which communicate with a hydrocarbon wellbore is disclosed. The apparatus includes a packer positioned in the wellbore for selectively preventing a flow of fluids through the wellbore from the first zone to the second zone, a production tubing string that extends through the wellbore and is in fluid communication through the packer with the second zone, and first and second pumps for displacing fluid through the production tubing string. The second pump displaces fluid from the lower zone into the production tubing string. A perforated joint is placed in the production tubing string between the second and the first pump. The second pump has a given displacement capacity at a given speed and is of a type that inhibits a flow of fluid in either direction through the pump when it is not pumping fluids from the second zone. The first pump is positioned in the production tubing above the second pump and has a predetermined displacement capacity at the pumping speed which is greater than the capacity of the second pump by the capacity desired to be produced from the first zone. The lower pump meters fluid from the lower zone and the upper pump produces fluids from the well so that both zones are produced simultaneously without fluid loss from either zone regardless of which zone has lower pressure. The means for controlling fluid communication through the packer depends on which zone has higher pressure. The advantage is a simple inexpensive apparatus for efficiently producing hydrocarbons from two production zones with pressure differentials without loss of fluid to either zone. Hydrocarbon production from the well is thereby maximized, stabilized and potentially prolonged.

14 Claims, 5 Drawing Sheets

APPARATUS AND METHOD FOR DUAL-ZONE WELL PRODUCTION

TECHNICAL FIELD

This invention relates to the production of fluid hydrocarbons from a hydrocarbon wellbore and in particular to the simultaneous production of fluid hydrocarbons from wellbores having two production zones which communicate with the wellbore.

BACKGROUND OF THE INVENTION

It is not uncommon for hydrocarbon wellbores to pass through two or more productive hydrocarbon formations or zones which have different production potentials. Because the production potentials of the different zones are unbalanced, it is undesirable to permit the fluids from different zones to freely co-mingle as the total production of the well may be adversely affected. In many jurisdictions, government regulations also prohibit the free co-mingling of fluid hydrocarbons from different production zones. One traditional method of producing a dual-zone well is therefore to isolate the zones using packers, or the like, and produce the well one zone at a time from the bottom of the bore up until each zone is exhausted. The problem with this method is that the production of the well fluctuates between production peaks for each zone and marginal production as each zone is exhausted. A further problem with this traditional method is that while a lower zone is being produced, hydrocarbon fluids in an upper zone may be irretrievably lost to another well, or the like.

Another traditional method of producing multi-zone wells is to produce each zone through a separate production string. There are several problems with this method. First, wellbores are often drilled without knowledge of the number of production zones that will be encountered. To economize drilling costs, bores are generally drilled and cased with casing of a diameter that will accommodate only one production tubing string. If multiple production zones are encountered in a wellbore of that diameter, multiple string production is impractical or impossible.

Apparatus for producing multiple zone oil and gas wells has been invented, as taught in U.S. Pat. No. 3,746,089 which issued on Jul. 17, 1973 to Vencil and U.S. Pat. No. 3,765,483 which issued on Oct. 16, 1973, also to Vencil. U.S. Pat. No. 3,346,089 teaches an apparatus for producing two or more oil and gas zones by allowing production from at least one zone to drain down to a common chamber where production from the zones is co-mingled and lifted to the earth surface by a single pump. A problem with this arrangement is that if natural pressure of the two zones is unbalanced, that zone will never be produced until the higher pressure zone is exhausted because the higher pressure zone will always overbalance production, leaving the lower pressure zone unproduced.

U.S. Pat. No. 3,765,483 teaches a method and apparatus for producing dual zone oil wells by permitting hydrocarbon fluids from each zone to drain into separate chambers where production from each zone is pumped by separate pumps driven by a common sucker rod string. The outputs from the separate pumps are comingled and conducted through one tubing to the surface. Production from the lower zone is pumped through a passageway that bypasses the upper zone and into the common tubing annulus where it is output for production. The passageway and a check valve through which production from the upper zone is drawn by a second pump are housed in an annular body. The two zones thus produce fluid hydrocarbons independently, and the hydrocarbons are co-mingled in a top of the production tubing above the second pump. The disadvantage of the apparatus is that the annular body is large complex and requires a wellbore of considerable diameter which could as easily accommodate two production strings.

SUMMARY OF THE INVENTION

It is an object of the invention to provide an apparatus for producing hydrocarbons from first and second zones in a well through a single production tubing string which is simple and inexpensive to construct.

It is a further object of the invention to provide an apparatus for producing fluid hydrocarbons from first and second zones in a well which permits the production from each zone to be metered at a desired rate so that the production from the well is consistently regulated.

It is a yet a further object of the invention to provide an apparatus for producing fluid hydrocarbons from first and second zones in a well wherein the tubing string including the pumps may be prepared on the surface and run into the well to produce the zones without loss of fluid hydrocarbons to a lower pressure zone before the production tubing string is run into the well, and at times when the production tubing string must be pulled from the well for pump maintenance, etc.

These and other objects of the invention are achieved in an apparatus for producing fluid hydrocarbons through a single production tubing string from first and second zones which communicate with a hydrocarbon wellbore, the first zone being nearer a top of the wellbore, comprising:

- a packer positioned in the wellbore between the first and second production zones;
- a production tubing string that extends through the wellbore and is in fluid communication through the packer with the second zone;
- a first pump for displacing fluids in a first direction when the pump is operated for pumping in that direction, the first pump having a predetermined capacity for pumping fluids in the first direction when operated at a predetermined speed;
- a second pump for displacing fluids in the first direction when the second pump is operated for pumping in that direction, the second pump being adapted to inhibit a flow of fluids through the pump in either direction when the pump is not operated for pumping, the second pump having a predetermined capacity for pumping fluids when operated at the predetermined speed, the capacity of the second pump being less than the capacity of the first pump when operated at the predetermined speed;
- the first and second pumps being operatively connected to the tubing string for respectively producing hydrocarbon fluids from the first zone and the second zone through the tubing string;
- means located between the first and second pumps for admitting hydrocarbon fluids from the first zone into the production tubing; and
- means for operating the first and second pumps at the predetermined speed.

In accordance with a further aspect of the invention there is provided a method for simultaneously producing fluid hydrocarbons from first and second zones which communicate with a hydrocarbon wellbore, comprising the steps of:

- setting a packer in the well bore between the first and second zones, the packer permitting selective fluid transfer between the second zone and a production tubing string when connected with the production tubing string;

preparing a tubing string which includes a first pump for producing fluid hydrocarbons from the first zone, a second pump for producing fluid hydrocarbons from the second zone and a perforated joint between the first and second pumps to permit fluid hydrocarbons to enter the tubing string between the first and second pumps, the first pump having a first capacity and the second pump having a second capacity for pumping fluid hydrocarbons, whereby the first capacity is greater than the second capacity by a volume about equal to a desired production capacity of the first zone, the second pump inhibiting a flow of hydrocarbons in either direction therethrough when the pump is not being driven for pumping;

inserting the tubing string into the well so that the selective fluid transfer between the second zone and the tubing string is enabled;

inserting a drive means through the production tubing string for driving the first and second pumps; and driving the first and second pumps at the same speed so that fluid hydrocarbons are produced from the second zone by the second pump into the tubing string and produced from the well by the first pump which lifts the fluid produced from the second zone along with a desired production from the first zone.

The invention, therefore, provides an apparatus and a method for producing hydrocarbons from a wellbore having first and second production zones with unbalanced fluid pressures. The apparatus is simple and economical to assemble and may be run down any well casing large enough to accept a single production tubing string. The apparatus in accordance with the invention includes a packer which is set between the two production zones to prevent fluid communication between the zones. The packer must be designed to permit fluid communication between the second zone and a pump positioned above the packer. The design of the packer is preferably dependent on whether the upper or the lower zone is a lower pressure zone (thief zone). If the upper zone is a thief zone, the packer can be a simple seal bore packer having a flow control valve with a spring biased clapper which closes a lower end of the seal bore preventing fluid communication through the packer. If the lower zone is a thief zone, then a different packer is required. The preferred packer for use in that circumstance is a novel packer construction hereinafter referred to as an "isolation packer" which preferably includes an on/off connector for fluid tight connection with a tubing string on a top end of the packer and a rotatable sleeve valve on a bottom end of the packer which may be selectively opened and closed by rotation of the tubing string from the surface to selectively control fluid communication between the tubing string and the thief zone.

In addition to a packer for isolating and selectively controlling fluid communication between the production zones, the apparatus further includes a tubing string having a first pump for producing fluid hydrocarbons from the first zone and a second pump for producing fluid hydrocarbons from the second zone. The first pump has a predetermined capacity for pumping fluids when operated at a given speed and the second pump has a predetermined capacity when operated at the given speed which is less than the predetermined capacity of the first pump. A perforated joint, or the like is positioned between the first and second pumps to permit fluid from the first zone to enter the production tubing string. Preferably, a first sucker rod string is used to operate the first pump and a second sucker rod string interconnects the first and second pumps so that the two pumps are operated at the same rate. When the pumps are operated, fluid hydrocarbons are produced through the second pump into the production tubing string. Because the first pump has a greater capacity, fluid hydrocarbons are drawn into the tubing string from the first zone and co-mingled with fluid produced from the second zone. The first pump lifts the co-mingled fluid hydrocarbons to the surface. While the fluids are co-mingled, co-mingling only occurs within the tubing string as long as both pumps are in operative condition.

The apparatus in accordance with the invention therefore permits controlled, metered simultaneous production from both production zones in spite of any hydraulic pressure differential between the two zones. If the lower zone is a high pressure zone, the second pump effectively meters production from the second zone, while the first pump produces hydrocarbon fluids from the first zone at the desired rate and lifts the production from both zones to the surface. If the lower zone is a thief zone, the second pump produces hydrocarbon fluids from the second zone while the first pump meters hydrocarbon fluids from the first zone and lifts the production from both zones to the surface. The capacity of each pump can be selected to produce the desired volume of fluids from each zone, thereby smoothing and potentially prolonging production from the well. Since fluid communication between the zones is prevented, the apparatus satisfies regulations in jurisdictions where fluid communication between different production zones is prohibited.

The pumps used in the apparatus in accordance with the invention are preferably Progressing Cavity Pumps (PCPs) however, any positive displacement pump which effectively inhibits fluid flow when not operated for pumping may be used in the apparatus in accordance with the invention. Examples of such pumps include plunger pumps and external helical gear pumps. If a plunger pump is used, it cannot be used where the upper zone is a thief zone unless a third valve is added which is opened and closed by the reciprocating movement of the plunger or the actuating rod. Such arrangements exist and are known in the art.

BRIEF DESCRIPTION OF THE DRAWINGS

The invention will now be explained by way of example only and with reference to the following drawings, wherein.

DETAILED DESCRIPTION OF THE PREFERRED EMBODIMENT

Figure 1:
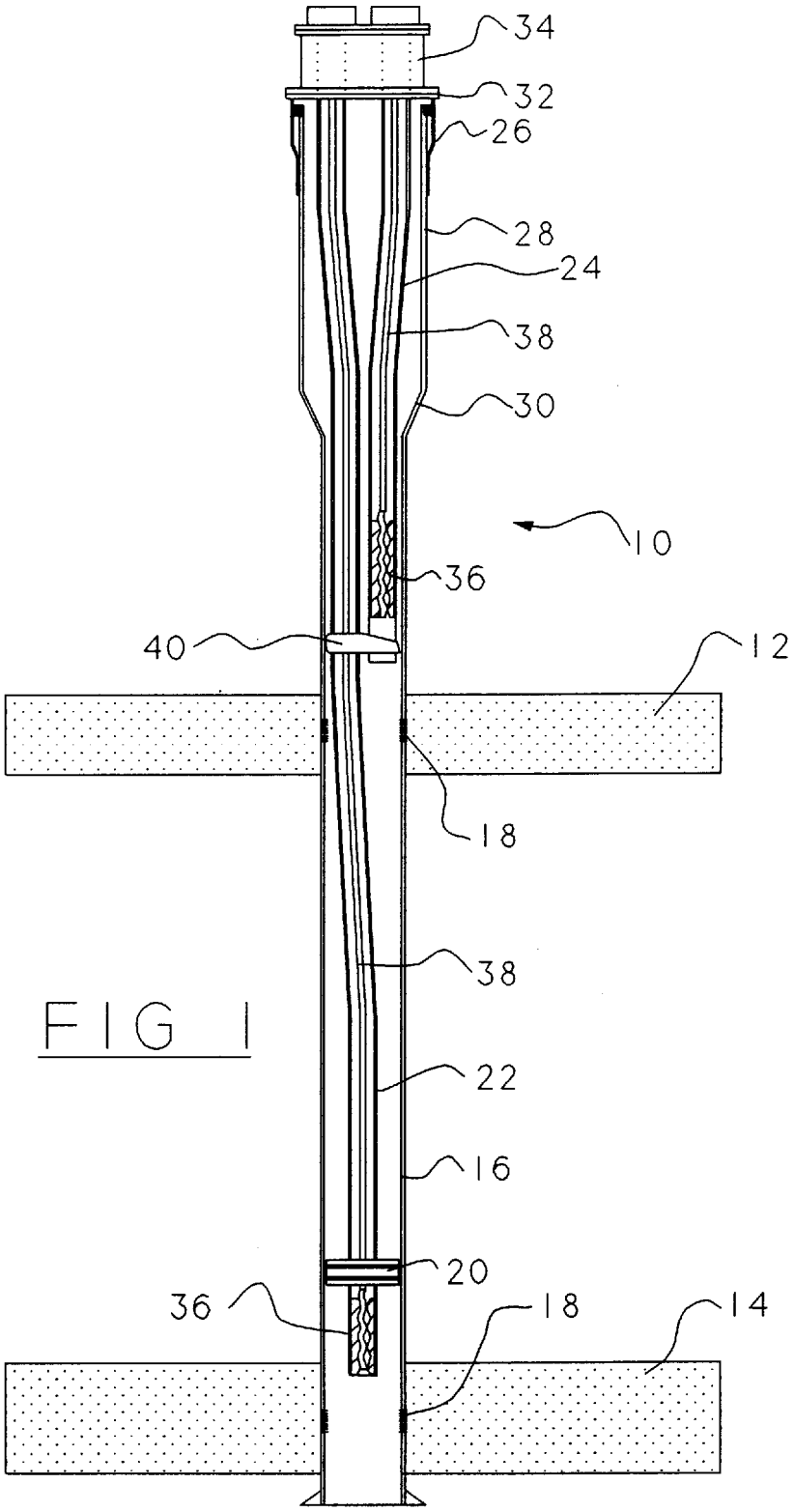
FIG 1 PRIOR ART
FIG. 1 is a schematic cross-sectional view of a prior art arrangement for simultaneously producing fluid hydrocarbons from two zones in a hydrocarbon wellbore.

FIG. 1 is a schematic diagram of a hydrocarbon wellbore 10 which passes through a first production zone 12 and a second production zone 14. For the purposes of example, the second or lower zone 14 is a high pressure zone and the first zone 12 is a low pressure zone commonly referred to as a "thief zone". The high pressure zone 14 may have a natural pressure adequate to lift hydrocarbons which enter the annulus through casing perforations 18 in a lower casing 16 to the perforations 18 at the thief zone 12, where the hydrocarbons could be lost into the thief zone 12 unless fluid communication between the two zones is prohibited. For this purpose, a packer 20, well known in the art, is set between the zones to prevent fluid from the higher pressure zone 14 from migrating into the lower pressure zone 12. In order to produce hydrocarbons simultaneously from both zones, the well in the illustrated prior art arrangement is produced using two independent production tubing strings consisting of a primary tubing string 22 and a secondary tubing string 24. This arrangement is only viable if the lower casing 16 is large enough to accommodate both strings, i.e. at least about 7". In a typical configuration of such a production arrangement, a surface casing 26 supports an upper casing 28 which is connected on its lower end to a cross-over, typically a crossover from 8⅝" to 7". The cross-over 30 interconnects the upper casing 28 and the lower casing 16, and is used in cases where the dual tubing suspension structure of the wellhead, a tubing head 34, separates the tubing strings enough that they will not fit directly into the smaller production casing 16. In this situation, the smaller production casing can be hung from the larger intermediate or surface casing, if this is feasible and permitted, or a cross-over to a larger casing is used so that there is sufficient length for the tubing to curve and enter the smaller production casing 16. Mounted to a top of the surface casing 26 is a casing head 32 which supports the tubing head 34. The tubing head 34 in turn supports the primary tubing string 22 and the secondary tubing string 24 as well as related pump drive equipment (not illustrated) in a manner well known in the art. At the bottom of each of the primary tubing string 22 and the secondary tubing string 24 is mounted a pump such as a Progressive Cavity Pump (PCP) 36, for example. The pumps are driven from the surface by sucker rod strings 38, in a manner well known in the art. The sucker rod strings are run through centralizers (not illustrated) to ensure that they do not wear against the sides of the tubing strings. A dual string anchor/latch assembly 40 is used to lock the two strings together below the PCP pump 36 attached to the lower end of the secondary tubing string 24 to ensure that the tubing strings are anchored to eliminate reciprocal movement between the strings and thus minimize wear.

The advantage of the apparatus shown in FIG. 1 is that both zones 12 and 14 are produced simultaneously at a desired production rate regardless of the fluid pressure of each zone. Since both zones are produced simultaneously, the production of the well is relatively stable and predictable and fluids are not lost from either of the zones to other wells due to interruptions in production. The principal disadvantages of this prior art practice is that the casing must be large enough to accommodate the two production tubing strings and the two specially configured strings with independent drives are required.

Figure 2:
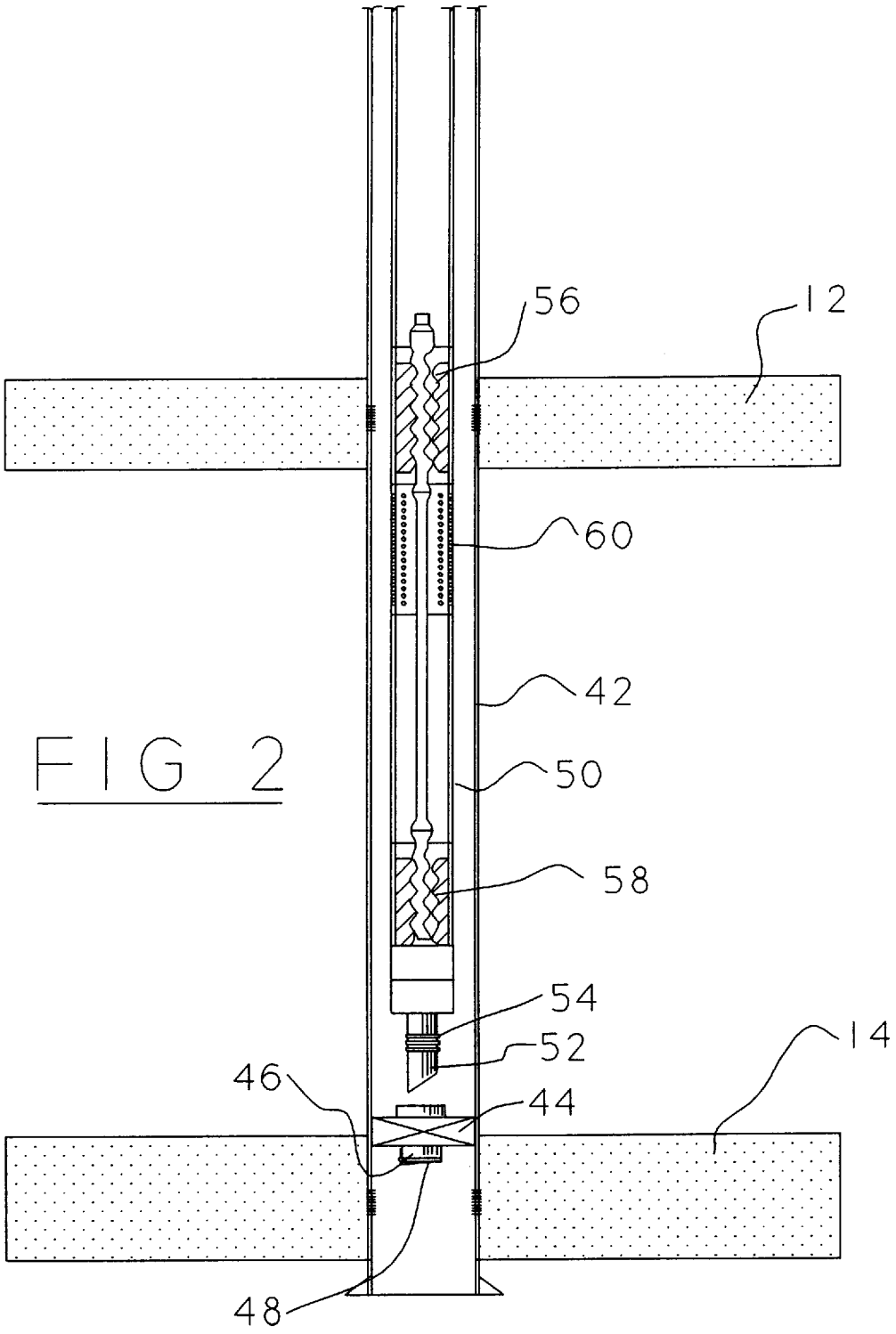
FIG. 2 is a schematic diagram partially in cross-section of a portion of a cased hydrocarbon wellbore with an apparatus in accordance with the invention suspended above a seal bore packer which isolates the two production zones in the well.

FIG. 2 shows a configuration for a first embodiment of an apparatus in accordance with the invention. This embodiment is intended for use when the first production zone 12 is a lower pressure zone than the second production zone 14. In order to produce the well, the casing 42 which communicates with both the upper zone 12 and the lower zone 14 is perforated to permit fluid flow into the casing from each of the zones. A seal bore packer 44 is set in the wellbore above the second production zone 14 with tubing or with wire line tools using techniques well known in the art. The seal bore packer 44 may be a permanent or retrievable type of packer. The seal bore packer 44 is equipped with a seal bore (not illustrated). The seal bore is a precision-machined bore that provides a surface to which a seal can be made with O-rings, as will be explained below in more detail. A check valve 46 is provided on the lower side of the packer to prevent a flow of fluids upwards through the seal bore of the packer when a spring biased flapper 48 is in a closed position. This type of packer is well known in the art and is typically used in high pressure gas wells which produce corrosive gases that must be prevented from entering the annulus above the packer.

A production tubing string 50 is run into the well to produce the first zone 12 and the second zone 14. In accordance with a preferred embodiment of the invention, a lower end of the production tubing string, which includes a pair of pumps such as PCP pumps, for example, is assembled at the surface. A lower end of the tubing string 50 includes a seal bore extension 52 which can be inserted through the seal bore in the packer 44 to force open the flapper 48 of the check valve 46 to provide fluid communication between the second production zone 14 and the tubing string 50. A seal is provided between the seal bore extension 52 and the seal bore in the packer 44 by a plurality of O-rings 54 retained in radial grooves on an outer surface of the seal bore extension 52. Located above the seal bore extension 52 is a first pump 56 and a second, positive displacement, pump 58. Each pump has a specific predetermined displacement capacity and head rating, as will be discussed in more detail with reference to FIG. 3. The first pump 56 and the second, positive displacement, pump 58 are interconnected by at least a perforated joint of tubing 60, typically a short joint commonly called a "pup" joint or a "sub". The perforated tubing joint 60 permits fluid hydrocarbons that flow from the upper production zone 12 to enter the tubing string 50, as will also be explained below with reference to FIG. 3.

Figure 3:
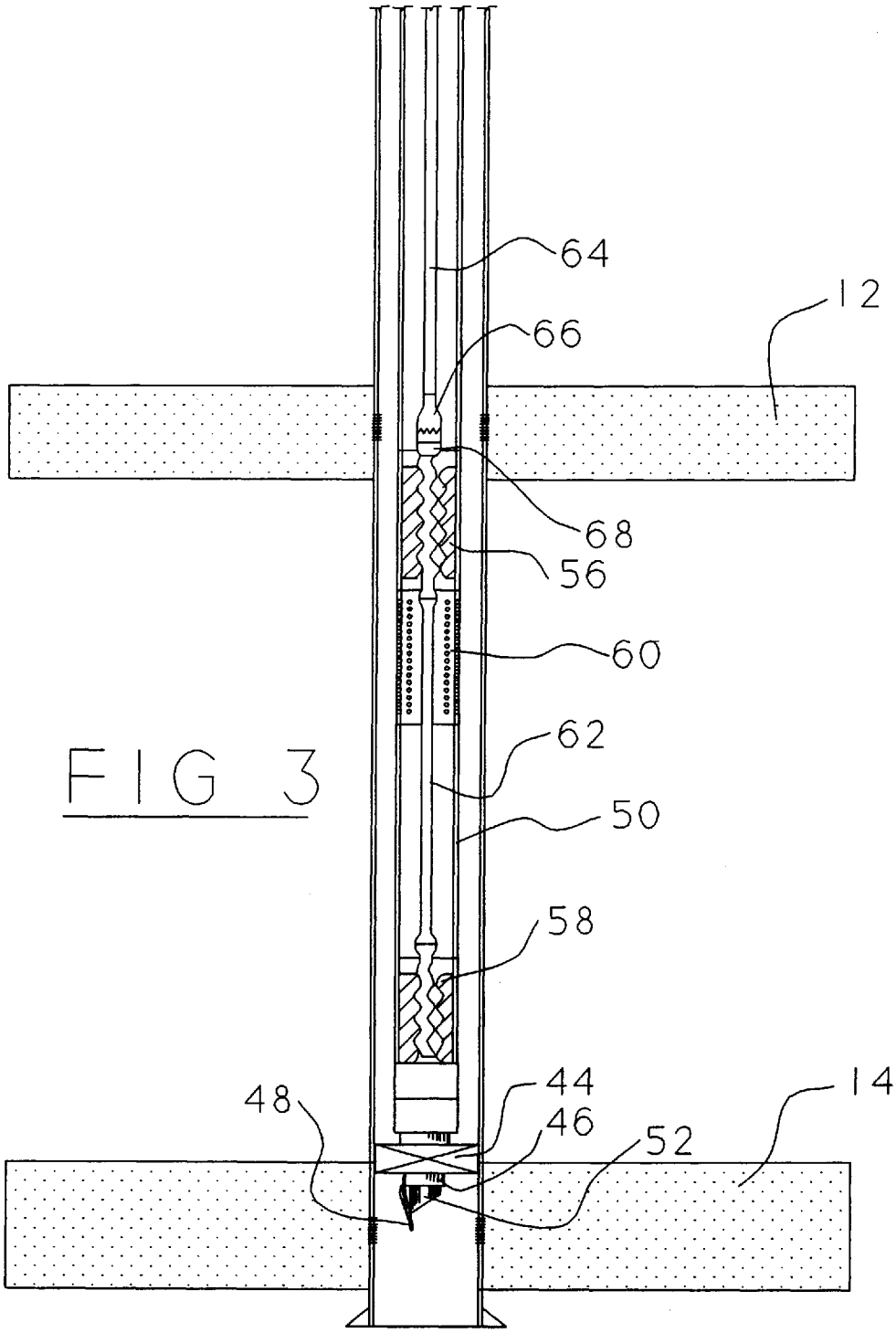
FIG. 3 shows the apparatus of FIG. 2, with the apparatus installed in an operative position in the wellbore and a sucker rod string operatively connected to produce fluids from the well.

FIG. 3 shows the tubing string described above run into the well so that the seal bore extension 52 extends through the seal bore of the packer 44 and forces the spring biased flapper 48 to an open position so that fluid hydrocarbons from the production zone 14 are in fluid communication with the production tubing string 50. The first pump 56 and the second, positive displacement, pump 58 are preferably PCP pumps which are interconnected by a length of sucker rod string 62 so that the pumps are driven at the same rate. After the production tubing string 50 is in a position for production as shown in FIG. 3, a drive string, typically a sucker rod string 64 is run into the production tubing string 50 from the surface. A bottom end of the drive string 64 preferably includes a female component 66 of an on/off connector. The female component 66 connects to a top of a male component 68 of an on/off connector. The male component 68 is attached to a top of the rotor of the first pump so that the drive string 64 can be rotated to drive the first pump 56 and the second pump 58 in unison.

In order to produce fluid hydrocarbons from the well, the drive string 64 is rotated to drive the first pump 56 and the second pump 58. As explained above, at least the second pump 58 is a positive displacement pump so that it inhibits fluid flow in either direction at all times when the pump is not being operated for pumping. Thus, fluid communication between the zones is controlled and no fluid is lost from the high pressure zone 14 to the low pressure zone 12 when the pumps are idle. When the pumps are driven, the second pump 58 meters fluid from the high pressure zone 14 into the annulus of the production tubing string 50. As explained above, the first pump 56 has a displacement capacity and enough head rating to lift the fluid hydrocarbon production to the surface, whereas the second pump 58 may have a low head rating because it only transfers fluid from the lower zone over a short lift interval. As noted above, when the lower zone is a high pressure zone the second pump 58 acts to meter fluid from the lower zone rather than pump it if the lower zone has adequate natural pressure to lift fluid hydrocarbons past the second pump 58. If so, when the drive string 64 is operated at the predetermined drive speed, fluid metered by the second pump 58 enters the production tubing string 50. Since the metered fluid flow through the second pump 58 is less than the displacement capacity of the first pump 56, fluid hydrocarbons are drawn from the second production zone 12 through the perforated tubing joint 60 and lifted to the surface. The respective displacement capacities of the first pump 56 and the second pump 58 determines how much fluid hydrocarbon is produced from each of zones 12 and 14. By selecting a suitable displacement capacity for each of the first pump 56 and the second pump 58, a desired rate of production from each zone is established and controlled.

If the tubing string 50 must be pulled to service a pump or the like, the flapper 48 of the check valve 46 closes to inhibit fluid flow from the second zone 14 to the first zone 12 and fluid communication between the zones is therefore prevented. After service is complete, the tubing string 50 is run back through the well and fluid communication with the tubing string is re-established when the seal bore extension 52 is inserted through the seal bore in the packer 44 to open the spring biased flapper 48.

Figure 4:
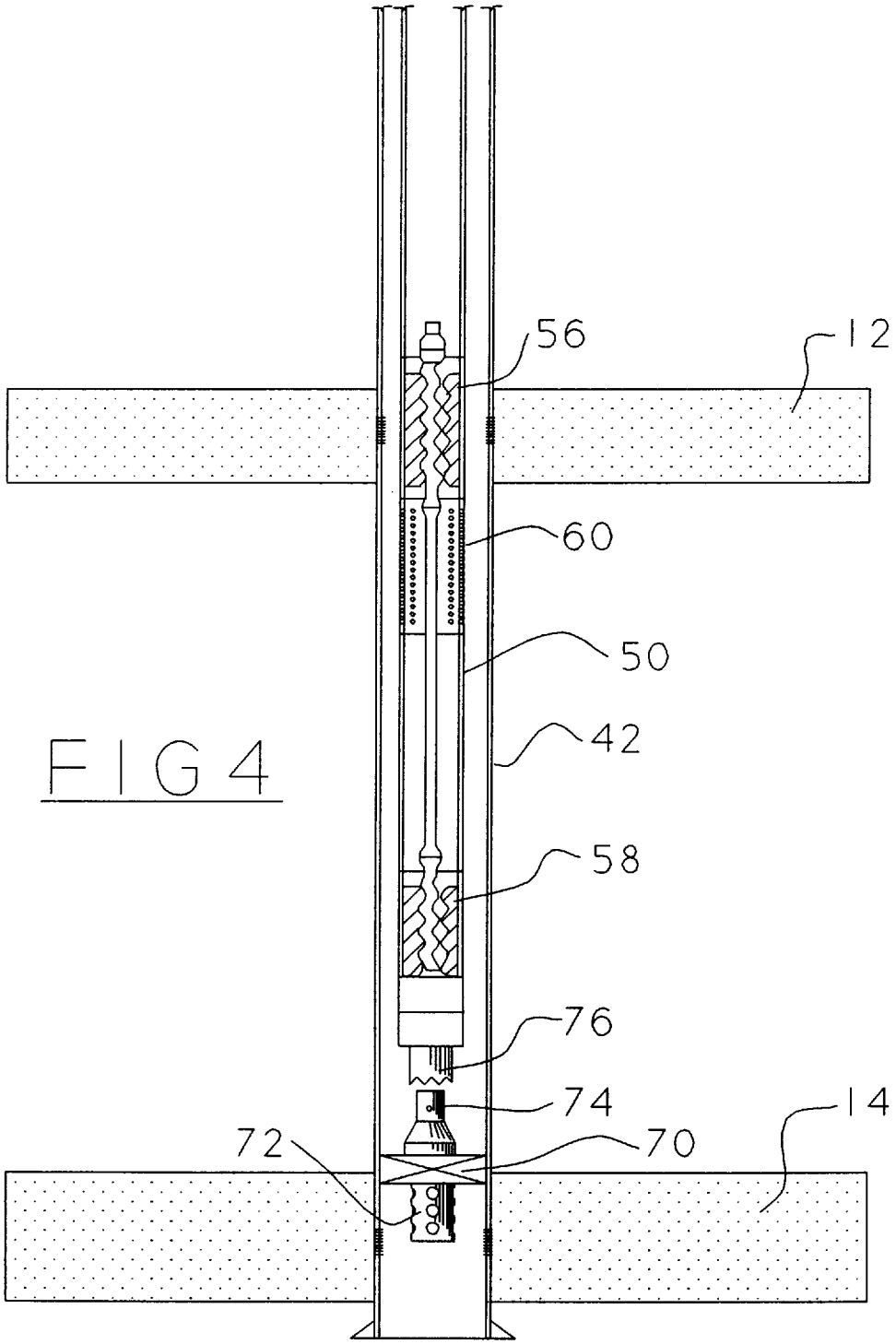
FIG. 4 is a schematic diagram partially in cross-section showing an apparatus in accordance with a second embodiment of the invention.

FIG. 4 shows a second preferred embodiment of the invention which is adapted for use when the first production zone 12 has a higher pressure than the second production zone 14. In this instance, a seal bore packer with a check valve as shown in FIGS. 2 and 3 is not necessarily satisfactory because the fluid pressure in the upper production zone could overbear the spring bias of the flapper 48 to permit fluid communication between the high pressure upper zone 12 and the lower pressure thief zone 14, in which instance fluid hydrocarbons could be lost to the lower pressure zone 14 and possibly to another well. A packer 70 (hereinafter referred to as an isolation packer 70) is run into the well with tubing or wireline tools, in a manner well known in the art. The isolation packer 70 includes an isolation valve 72 connected to its lower end and a male component 74 of an on/off latch assembly mounted to its upper end. The isolation valve 72 includes an inner mandrel (not illustrated) connected for rotation with the male component 74 of the on/off latch assembly and an outer mandrel fixedly connected to the isolation packer 70. Each mandrel includes a plurality of radial bores which may be aligned when the inner mandrel is rotated relative to the outer mandrel so that aligned ports in the two mandrels permit fluid flow through the isolation valve 72. Rotation of the inner mandrel is accomplished by rotation of the male component 74 of the on/off latch assembly mounted to the upper end of the isolation packer 70. Attached to a lower end of the production tubing string 50 is a female component 76 which mates with the male component 74 of the on/off latch assembly to permit the isolation valve to be operated from the surface by rotation of the production tubing string 50. In all other respects, the production string 50 includes the same components as described above in relation to FIGS. 2 and 3. The first pump 56 and the second, positive displacement, pump 58 have predetermined respective displacement capacities and head ratings so that the second pump 58 produces fluid from the lower zone 14 into the production tubing string 50 which is co-mingled with production from the upper zone 12 drawn through the perforated joint 60 by the first pump 56 and lifted to the surface, as described above.

Figure 5:
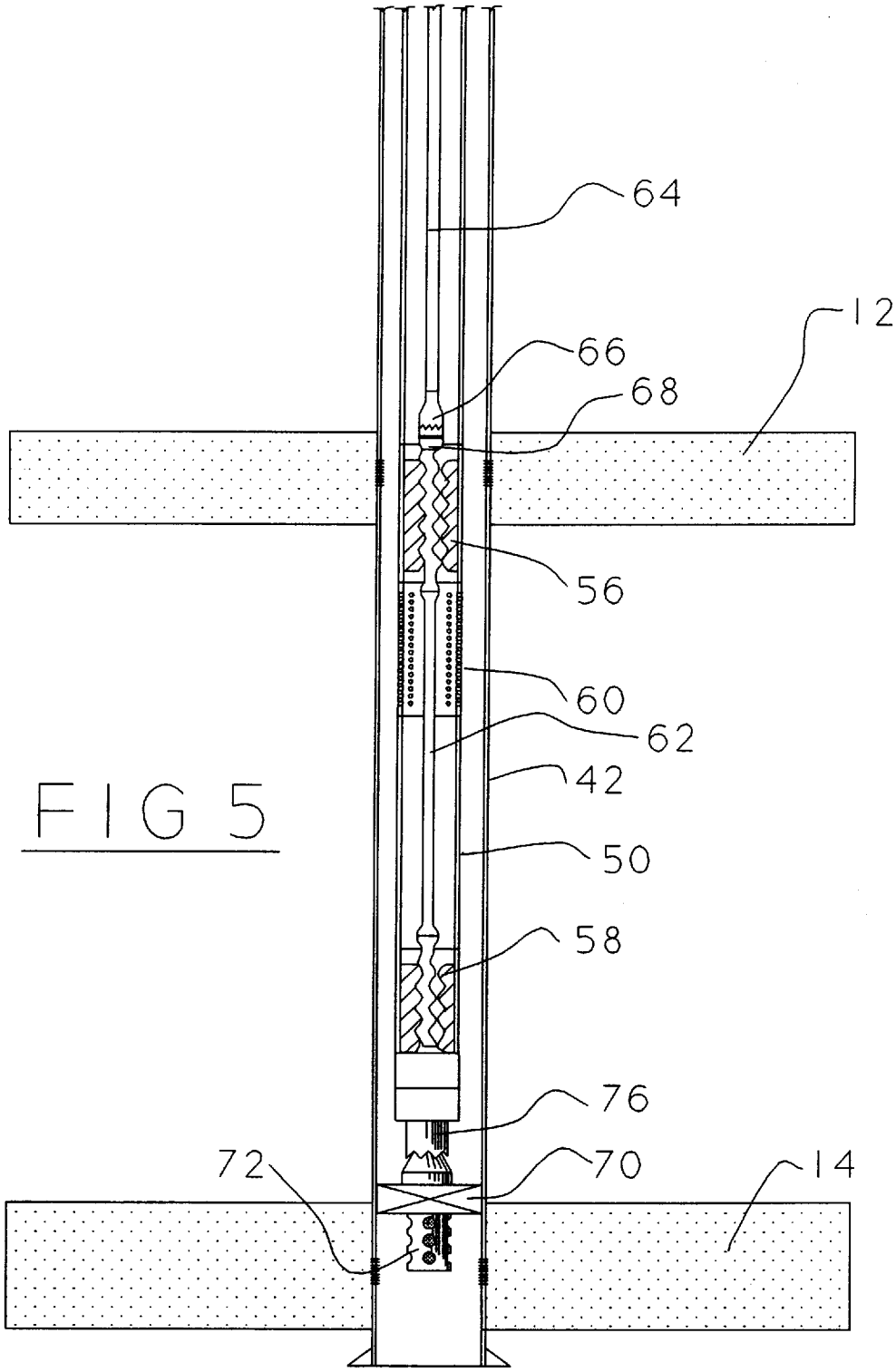
FIG. 5 shows the apparatus of FIG. 4 with the tubing string in a position for producing fluid hydrocarbons from the well and a sucker rod string operatively connected to the apparatus.

FIG. 5 shows the production tubing string 50 run through the well casing 42 with the female component 76 of the on/off latch assembly seated on and connected to the male component 74 (see FIG. 4) attached to the top of the isolation packer 70. After the on/off latch assembly is manipulated into engagement, the tubing string 50 is rotated about ¼ turn to open the ports in the isolation valve 72 to permit fluid communication between the tubing string 50 and the second production zone 14. Because the second pump 58 is a positive displacement pump, no fluid migrates from the upper production zone 12 into the low pressure thief zone 14. Fluid seals in the on/off latch assembly 74, 76 prevent fluid flow from the annulus of the casing 42 to the isolation valve 72. Thus, fluid flow between the first production zone 12 and the second production zone 14 is prevented. After the tubing string 50 is run into the well, a drive string 64 (typically a sucker rod string) is run into the production tubing string 50 and a female component of an on/off connector 66 engages a male component 68 attached to a top of the rotor of the first pump 56. When the drive string 66 is rotated, both the first pump 56 and the second pump 58 produce hydrocarbons from the respective production zones, as explained above. If a pump needs to be serviced, the production tubing string 50 is rotated to close the isolation valve 72. The on/off latch assembly is disconnected, and the drive string 64 is run out of the production tubing string 50 and the production tubing string 50 is run out of the well to effect the required repairs. The isolation packer 70 ensures that no fluid communication between the upper zone 12 and the lower zone 14 occurs while the pumps are being serviced. After servicing, the production tubing string 50 is run back into the well and the isolation valve 72 is opened, as explained above. The drive string 54 is run into the production tubing string 50, and normal production can resume.

It will be understood by those skilled in the art that the pumps in the production tubing string 50 may be insert pumps so that the pumps can be withdrawn with the drive string 64 as an alternative to running the production tubing string 50 out of the well in order service the pumps. If insert pumps (not illustrated) are used, the lower pump must be set in smaller tubing, for example 2⅞" API (approximately 2½" ID) and the upper pump must be set in a larger tubing, for example 3½" API (approximately 3" ID) so that the second pump assembly can pass through the seating nipple for the first pump assembly. With this exception, all of the principles described above apply, and each pump is selected to have a displacement capacity to produce a desired production from each zone when the pumps are driven in unison at a predetermined speed.

Those skilled in the art will understand that use of a packer with a check valve 46 or an isolation valve 72 is not essential if temporary fluid communication between the upper zone 12 and the lower zone 14 can be tolerated for a period of time required to run the tubing string 50 into or out of the well. It is nonetheless preferred that fluid communication between the upper zone 12 and lower zone 14 be inhibited by use of the seal bore packer 44 or the isolation packer 70 described above, depending on the relative hydraulic pressures of the upper zone 12 and the lower zone 14.

Those skilled in the art will also understand that the isolation packer 70 (see FIGS. 4 and 5) can be used for isolating the two production zones regardless of which zone has a higher pressure. The seal bore packer 44 (see FIGS. 2 and 3) is only preferred when the second zone is a high pressure zone because it is less expensive to manufacture. It will be further understood that other types of packers and valves than those described above can be used to selectively inhibit fluid flow between the first and second zones.

The embodiments of the invention described above are intended to be exemplary only and not limiting to the scope or spirit of the invention which is intended to be limited only by the scope of the appended claims.

I claim:

1. Apparatus for producing fluid hydrocarbons through a single production tubing string from first and second production zones which communicate with a hydrocarbon wellbore, the first zone being nearer a top of the bore, comprising:

a packer positioned in the wellbore between the first and second production zones;

a production tubing string that extends through the wellbore and is in fluid communication through the packer with the second zone;

a first pump for displacing fluids in a first direction when the pump is operated for pumping in that direction, the first pump having a predetermined capacity for pumping fluids in the first direction when operated at a predetermined speed;

a second pump for displacing fluids in the first direction when the second pump is operated for pumping in that direction, the second pump being adapted to inhibit a flow of fluids through the pump in either direction when the pump is not operated for pumping, the second pump having a predetermined capacity for pumping fluids when operated at the predetermined speed, the capacity of the second pump being less than the capacity of the first pump when operated at the predetermined speed;

the first and second pumps being operatively connected to the tubing string for respectively producing hydrocarbon fluids from the first zone and the second zone through the tubing string;

means located between the first and second pumps for admitting hydrocarbon fluids from the first zone into the production tubing; and means for operating the first and second pumps at the predetermined speed.

2. The apparatus for producing fluid hydrocarbons from first and second zones which communicate with a hydrocarbon wellbore as claimed in claim 1, wherein the means for operating the first pump is a sucker rod string.

3. The apparatus for producing fluid hydrocarbons from first and second zones which communicate with a hydrocarbon wellbore as claimed in claim 2, wherein the means for operating the second pump is a sucker rod string interconnecting the first and second pumps.

4. The apparatus for producing fluid hydrocarbons from first and second zones which communicate with a hydrocarbon wellbore as claimed in claim 1, wherein the first zone is a thief zone and the packer is a seal bore packer with a check valve having a spring biased flapper located on a downhole end of the packer that normally closes the seal bore in the packer.

5. The apparatus for producing fluid hydrocarbons from first and second zones which communicate with a hydrocarbon wellbore as claimed in claim 4, wherein a bottom end of the production tubing includes a seal bore extension which forces the spring biased flapper to an open position when the seal bore extension is inserted through the seal bore of the seal bore packer.

6. The apparatus for producing fluid hydrocarbons from first and second zones which communicate with a hydrocarbon wellbore as claimed in claim 1, wherein the second zone is a thief zone and the packer is an isolation packer which includes an isolation valve with a fluid flow path that may be selectively opened or closed by movement of the production tubing string.

7. The apparatus for producing fluid hydrocarbons from first and second zones which communicate with a hydrocarbon wellbore as claimed in claim 6, wherein the production tubing string is connected to the isolation packer by an on/off latch assembly.

8. A method for simultaneously producing fluid hydrocarbons from first and second zones which communicate with a hydrocarbon wellbore, comprising the steps of:

setting a packer in the wellbore between the first and second zones, the packer permitting selective fluid transfer between the second zone and a production tubing string when connected with the production tubing string;

preparing a tubing string which includes a first pump for producing fluid hydrocarbons from the first zone, a second pump for producing fluid hydrocarbons from the second zone and a perforated joint between the first and second pumps to permit fluid hydrocarbons to enter the tubing string between the first and second pumps, the first pump having a first capacity and the second pump having a second capacity for pumping fluid hydrocarbons, whereby the first capacity is greater than the second capacity by a volume about equal to a desired production capacity of the first zone, the second pump inhibiting a flow of hydrocarbons in either direction therethrough when the pump is not being driven for pumping;

inserting the tubing string into the well so that the selective fluid transfer between and the second zone and the tubing string is enabled;

inserting a drive means through the production tubing for driving the first and second pumps;

driving the first and second pumps at the same speed so that fluid hydrocarbons are produced from the second zone by the second pump into the tubing string and produced from the well by the first pump which pumps the fluid produced from the second zone plus the desired production from the first zone.

9. The method for simultaneously producing fluid hydrocarbons from first and second zones which communicate with a hydrocarbon wellbore as claimed in claim 8 wherein the first zone is a thief zone and the packer is a seal bore packer having a seal bore that is normally closed by a biased flapper of a check valve.

10. The method for simultaneously producing fluid hydrocarbons from first and second zones which communicate with a hydrocarbon wellbore as claimed in claim 8 wherein the second zone is a thief zone and the packer is an isolation packer that includes an isolation valve which may be selectively opened and closed for fluid communication with the thief zone by movement of the tubing string from a wellhead of the wellbore.

11. The method for simultaneously producing fluid hydrocarbons from first and second zones which communicate with a hydrocarbon wellbore as claimed in claim 9 wherein a bottom end of the tubing string includes a seal bore extension which is inserted through the seal bore in the seal bore packer and opens the biased flapper.

12. The method for simultaneously producing fluid hydrocarbons from first and second zones which communicate with a hydrocarbon wellbore as claimed in claim 10 wherein a bottom end of the tubing string includes a female component of an on/off connector and the female component engages a male component of the on/off connector mounted to a top of the isolation packer.

13. The method for simultaneously producing fluid hydrocarbons from first and second zones which communicate with a hydrocarbon wellbore as claimed in claim 12 wherein selective fluid transfer is enabled from the second zone to the tubing string by movement of the tubing string from the wellhead.

14. The method for simultaneously producing fluid hydrocarbons from first and second zones which communicate with a hydrocarbon wellbore as claimed in claim 13 wherein the tubing string is moved to close the isolation valve whenever the tubing string is to be disconnected from the isolation packer.

* * * * *